United States Patent [19]

Churchland et al.

[11] Patent Number: 4,546,886

[45] Date of Patent: Oct. 15, 1985

[54] METHOD AND APPARATUS FOR SORTING ELONGATE ARTICLES

[75] Inventors: Mark T. Churchland, Burnaby; Walter W. Schilling, Delta, both of Canada

[73] Assignee: MacMillan Bloedel Limited, Vancouver, Canada

[21] Appl. No.: 406,768

[22] Filed: Aug. 10, 1982

[51] Int. Cl.[4] ..... B07B 13/04

[52] U.S. Cl. ..... 209/665; 209/521; 209/620

[58] Field of Search ..... 209/517, 521, 617, 618, 209/660, 665, 695, 667, 903, 659, 620, 606, 707; 198/457

[56] References Cited

U.S. PATENT DOCUMENTS

| | | | |
|---|---|---|---|
| 378,796 | 2/1888 | Linderman | 209/517 |
| 964,670 | 7/1910 | Moncreiffe | 209/521 |
| 2,371,877 | 3/1945 | Crosland | 198/457 |
| 2,501,403 | 3/1950 | McKinsey | 209/539 |
| 2,662,640 | 12/1953 | Dedo | 209/521 |
| 3,080,052 | 3/1963 | Hanbury | 209/520 |
| 3,106,291 | 10/1963 | Tisch | 209/542 |
| 3,150,022 | 9/1964 | Vida | 209/620 |
| 3,399,768 | 9/1968 | Holmberg et al. | 209/514 |
| 3,463,312 | 8/1969 | Barton | 209/663 |
| 3,469,690 | 9/1969 | Ervin | 209/521 |
| 4,061,819 | 12/1977 | Barnes | 428/294 |
| 4,219,120 | 8/1980 | Rysti | 209/521 |

FOREIGN PATENT DOCUMENTS

| | | | |
|---|---|---|---|
| 1448459 | 7/1930 | Fed. Rep. of Germany . | |
| 404729 | 10/1973 | U.S.S.R. . | |
| 878365 | 11/1981 | U.S.S.R. | 209/606 |

*Primary Examiner*—David A. Scherbel
*Assistant Examiner*—Donald T. Hajec
*Attorney, Agent, or Firm*—Banner, Birch, McKie & Beckett

[57] ABSTRACT

A method and apparatus for sorting elongate articles by length is disclosed. The apparatus includes a first conveyor belt, a second conveyor belt, a holding mechanism located at the discharge end of the first conveyor belt and a grasping mechanism located at an inlet end of the second conveyor belt. The holding and grasping mechanisms are spaced from one another by a gap through which articles having a length less than a preselected length fall. The holding mechanism holds the articles which pass the discharge end of the first conveyor belt in alignment with a plane in which the top run of the first conveyor belt moves. The grasping mechanism grasps the front ends of desired elongate articles which have a length equal to or greater than the preselected length prior to the release of the rearward ends of the desired articles from the holding mechanism.

5 Claims, 1 Drawing Figure

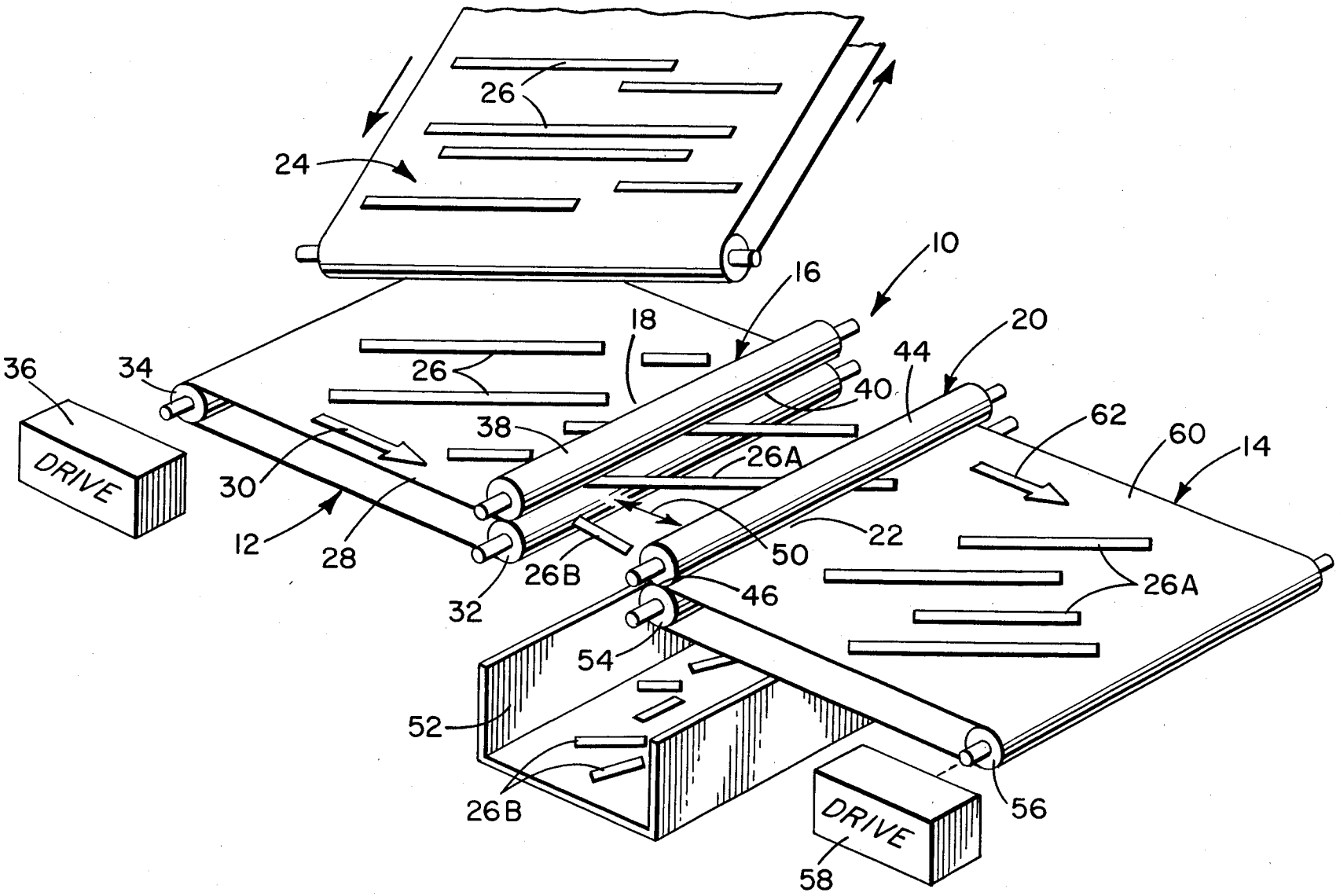
10
12
14
16
18
20
22
24
26
26A
26B
28
30
32
34
36
38
40
44
46
50
52
54
56
58
60
62
DRIVE
DRIVE

METHOD AND APPARATUS FOR SORTING ELONGATE ARTICLES

TECHNICAL FIELD

The present invention relates broadly to the field of apparatus which sort articles by size. More particularly, the invention relates to the field of wood product manufacture and a method and apparatus for sorting wood strands by length.

BACKGROUND OF THE INVENTION

Numerous types of sorting devices have been used in the past to sort objects by size. Prior sorting devices generally operate by dropping out objects of a particular size from a flow path of moving objects. Selection of the objects to be taken out of the flow path is accomplished by various techniques, for example, by sensors which measure the objects and control the opening and shutting of gates or doors to drop the objects out of the path, or by passing the objects over holes of various sizes with the holes dimensioned to drop objects of specific sizes out of the flow path.

U.S. Pat. No. 3,080,052 illustrates an example of a sorting apparatus which utilizes sensors. The sensors are placed in a path of transversely moving lumber. The sensors measure either width, length, thickness or grade of the lumber. When the sensor measures a piece of lumber with a particular width, length, thickness or grade which is to be selected, the sensor opens a gate through which the particular piece of lumber passes.

U.S. Pat. Nos. 2,662,640; 3,106,291; 3,150,022 and 3,469,690 disclose sorting apparatus wherein objects are selected by dropping through sized holes in a flow path. The '690 patent discloses a method and apparatus for sorting objects according to length, in particular wooden billets cut from rough log sections. The apparatus conveys the billets over a series of spaced conveyor belts. The spacing between the conveyor belts gradually increases between successive pairs of belts. Holding rollers are suspended at spaced positions above the inlet and discharge ends of each conveyor. The holding rollers at the discharge end of the conveyors apparently provide a certain amount of support for the billets passing over the discharge end of the conveyor, however, these rollers permit the billets to fall downwardly away from horizontal. If the billet is to be passed onto a successive conveyor belt, the billet comes into contact with an upwardly slanted run of the successive conveyor belt. The upwardly slanted run of the conveyor belt lifts the billet to a horizontal position where it then comes into contact with a holding roller located a distance above the horizontal run of the of the successive conveyor belt. Such a non-level flow of objects through a sorting system is undesirable, particularly when relatively high speed sorting is required. If the conveyors were run at relatively high speeds, the downwardly falling objects would strike the upwardly slanted run of a successive conveyor with higher force, possibly causing damage or contributing to belt failure.

A process has recently been developed for manufacturing structural wood products from long, relatively thin strands of wood by coating the strands with an adhesive, arranging the strands side-by-side in a lengthwise dimension of the lumber product and subjecting the arranged strands to compression. By this technique, a high strength dimensioned wood product can be formed. An example of such a process is disclosed in U.S. Pat. No. 4,061,819. In this manufacturing technique, relatively thin wood strands desirably are sorted according to length because, inter alia, the longer strand lengths enhance the properties of the final product. Since a large number of wood strands are required to manufacture the wood products, there is a need for a process and apparatus to rapidly sort the wood strands by length. The present method and apparatus was developed to fill this need.

SUMMARY OF THE INVENTION

The present invention is directed to an apparatus for sorting elongate articles of varying length into desired articles having a length equal to or above a preselected length and undesired articles having a length less than the preselected length. The apparatus includes a first conveyor means for carrying a plurality of elongate articles on its top run. A drive means drives the conveyor means in a direction to move the top run toward a discharge end of the conveyor means to thereby convey the elongate articles past the discharge end. A holding means adjacent to the discharge end holds the elongated articles substantially in a plane in which the top run moves immediately preceeding the discharge end. A grasping means grasps the forward ends of the desired elongated articles passing from the discharge end of the conveyor means and moves the desired elongated articles in a direction away from the holding means after the elongate articles have been released by the holding means. The grasping means is located a distance away from the holding means to form a gap therebetween. The gap has a length such that the desired elongate articles are grasped by the grasping means before release by the holding means and the undesired elongate articles are not grasped by the grasping means when they are released by the holding means so that they fall into the gap.

In a preferred embodiment, a second conveyor means conveys the desired articles away from the holding means. The grasping means includes a support roller of the second conveyor means and a grasping roller above the support roller forming a nip for grasping the desired elongate articles. A drive means moves the second conveyor means and rotates the support roller to move the desired elongate articles away from the holding means. The holding means is preferably comprised of a holding roller disposed above a support roller of the conveyor means at its discharge end. The undesired elongate articles fall into a collection bin, or the like.

For ease of presentation, the conveyor means will be referred to as a conveyor belt which is preferred for the practice of this invention. It is to be understood, however, that conveyor chains, or the like, could also be employed. Somewhat similarly, while this specification refers to desired and undesired articles, it is to be understood that both sets of articles can be useful.

The present invention is also directed to a method for sorting wood strands of varying lengths into desired strands having a length equal to or above a preselected length and undesired strands having a length less than the preselected length. The method is comprised of the steps of: depositing a plurality of wood strands having varying lengths onto a top run of the moving conveyor belt with the lengthwise dimension of the strands within an angle of about 60° of the direction of motion of the conveyor belt; driving the conveyor belt to move the top run of the conveyor belt toward a discharge end thereof and convey the strands to the discharge end of the conveyor belt; continously holding with holding means the strands as they pass the discharge end of the conveyor belt in the plane in which the top run of the conveyor belt travels in the area adjacent the discharge end until the strands pass the holding means; grasping the forward ends of the desired strands with a grasping means located a distance from the end of a first conveyor belt before the rearward ends of the desired strands are released by the holding means; forming a gap between the holding means and the grasping means; dropping the undesired strands into the gap between the holding means and the grasping means; and conveying the desired strands away from the grasping means.

The present invention has an advantage of being capable of sorting a large number of wood strands at a relatively high speed. The leading edge of adjacent strands need not be aligned nor does any strand have to be positioned directly behind the strand preceeding it on the conveyor. The conveyor belts can be driven, for example, at a linear speed of between 10 and 200 feet per minute and up to approximately 50 strands per second can be sorted.

When the strands are delivered at an angle relative to the direction of motion of the first conveyor belt, the gap length between the first conveyor belt and the grasping rollers can be shortened for a given desired length of the strands. By depositing strands at an angle to the direction of motion, for example 45°, the strands tend to separate on the conveyor and there is consequently a reduced tendency for shorter strands to be carried across the gap by the longer strands.

The holding roller and the support roller at the discharge end of the first conveyor belt hold the strands substantially aligned with the plane of the top run of the first conveyor belt. The nip of the grasping roller and the support roller at the inlet end of the second conveyor belt is also aligned with this plane. The desired strands thus follow a straight line path through the gap and additional downward and upward motion is not required to cross the gap.

Various advantages and features of novelty which characterize the invention are pointed out with particularity in the claims annexed hereto and form a part hereof. However, for a better understanding of the invention, its advantages and objects obtained by its use, reference should be had to the drawing which form a further part hereof, and to the accompanying descriptive manner in which there is illustrated and described an embodiment of the invention.

BRIEF DESCRIPTION OF THE DRAWING

The FIGURE is a perspective view of a sorting apparatus in accordance with the present invention.

DETAILED DESCRIPTION OF THE INVENTION

Referring to the FIGURE, there is shown a sorting apparatus in accordance with the present invention, designated generally as 10. Sorting apparatus 10 includes a first conveyor belt 12, a second conveyor belt 14, a holding means 16 located at a discharge end 18 of conveyor belt 12 and a grasping means 20 located adjacent an inlet end 22 of conveyor belt 14. A depositing mechanism is illustrated diagrammatically as 24 at a location above first conveyor belt 12.

Depositing mechanism 24 places elongate articles 26 onto a top run 28 of conveyor belt 12 at an angle relative to the direction of motion of top run 28. The direction of motion of top run 28 is illustrated as arrow 30. Articles 26 are preferably deposited at about an angle of from about 30° to about 60° and most preferably at an angle of about 45° to direction 30. Mechanism 24 can be any suitable type of conveyor, for example, another conveyor belt or downwardly slanted trough. In an alternate embodiment, the elongate articles may be placed on conveyor belt 12 substantially parallel to the direction of movement of belt 12. If desired, such elongate articles may be deposited from a conveyor whose discharge end moves back and forth across the width of belt 12.

Elongate articles 26 have varying lengths. Elongate articles 26, in a preferred form of the present invention, are relatively thin wood strands which are to be used in a process of manufacturing high strength wood products.

Conveyor belt 12 is trained about and supported by support rollers 32, 34. Support roller 32 is located at discharge end 18. It should be recognized that the FIGURE is diagrammatic and that in actual practice, belt 12 may be disposed about more rollers. Moreover, the upper run of the conveyor can be supported, for example, by running it over a planar surface. One of the rollers, shown in the FIGURE as roller 34, is connected to a drive motor 36 which moves conveyor belt 12 in direction 30. In this manner, elongate articles 26 are transported to discharge end 18 of conveyor belt 12.

A holding roller 38 is rotatably supported above and parallel with roller 32. Roller 38 is held in bearings along the uppermost portion of support roller 32 to form a first nip 40. As elongate articles 26 pass discharge end 18, they pass through nip 40 and are held between rollers 32, 38 substantially within the same plane as top run 28 immediately adjacent discharge end 18. The articles 26 are continuously held in this aligned position substantially until they are released from nip 40. Rollers 32, 38 thus function as means 16 for holding the elongated articles 26 aligned with the plane of top run 28, as they pass discharge end 18. The weight of roller 38 may provide the force necessary to hold articles 26 aligned with the plane of top run 28. For wood strands, the weight of roller 38 generally provides sufficient force. If a particular force is required for the certain articles 26, a conventional biasing mechanism can be connected to roller 38 to provide the requisite force at the nip.

Second conveyor belt 14 is shown diagrammatically trained about a pair of support rollers 54, 56. Roller 56 is rotated by drive motor 58 to move a top run 60 of conveyor belt 14 in the direction of arrow 62 and to rotate roller 54 at inlet end 22 of conveyor belt 14. A grasping roller 44 is rotatably supported above and parallel with roller 54. Roller 44 is held in bearings which permit roller 44 a limited amount of vertical movement. As shown, the bearings are positioned so that roller 44 contacts and freely rests on conveyor belt 14 along the uppermost portion of support 44, 54 to form a second nip 46. Grasping means 20 is thus formed by rollers 44, 54.

Inlet end 22 and rollers 44, 54 are spaced from rollers 38, 32 to define a gap 50 between them. The length of gap 50 is chosen so that desired elongate articles **26*a*, which have a length equal to or greater than a preselected length, will have their forward ends grasped within nip 46 prior to their release from nip 40, when the articles are conveyed on conveyor belt 12 at a predetermined angle, for example 45°. Undesired elongate articles 26b which have a length less than the preselected length will not be grasped in nip 46 prior to their release from nip 40, and thus will fall through gap 50. A collection bin 52 is placed beneath gap 20 to receive the undesired elongate articles 26b. If desired, a conveyor may be used in conjunction with or as a substitute for bin 50 to transport articles 26b away from apparatus 10**.

Nip 46 is aligned with nip 40 and the plane of top run 28. Since the pressure of roller 38 on articles 26 in nip 40 holds the articles 26 aligned with this plane, desired elongate articles 26a experience straight through transfer to nip 46 without moving substantially out of the plane of top run 28. Roller 44 can rest freely on top of conveyor belt 14 with its weight providing a force to hold articles 26a aligned with the plane of top run 28 after the release of the rearward ends of articles 26a from nip 40. As with roller 38, if a particular force is required, a biasing mechanism can be attached to roller 44.

As the desired elongate articles 26a exit nip 46, they rest on a top run 60 of conveyor belt 14. Top run 60 is driven in direction 62 to carry the desired elongate articles away from nip 46. If desired, elongate articles at an angle on conveyor belt 14 can be dropped onto another belt (not shown) moving in the same direction as belt 24 so that the elongate articles are again essentially perpendicular to the direction of movement of such belt. If such transfer is made, a nip roller can be positioned over roller 56 to assist in the orderly transfer of the articles to the additional belt.

While the above discussion relates to movable rollers which provide the desired nip force, fixed rollers having a compressible surface layer (e.g., rubber) can also be employed. A movable roller having a compressible surface layer, of course, could also be employed if desired. It will be apparent that the rollers which form nips 40 and/or 46 need not be in contact when no article is passing through the nip. The rollers can be positioned so that there is always a slot of appropriate size between them.

A method for sorting wood strands in accordance with the present invention would operate as follows. In the following description elongate articles 26 will be referred to as wood strands. The term wood strands is intended to be generic to any of the materials which can be used in the method of wood product manufacture as disclosed in U.S. Pat. No. 4,061,819, the disclosure of which is hereby incorporated by reference.

Wood strands 26 of varying length are deposited on top run 28 of first conveyor belt 12 at an angle, preferably 45°, relative to the direction of motion 30 by mechanism 24. Belt 12 is driven so that the strands 26 are conveyed past discharge end 18 by top run 28. Strands 26 are continuously held in substantial alignment with the plane in which top run 28 moves, in the area adjacent discharge end 18, by rollers 32, 38 as they pass discharge end 18. Forward ends of desired strands 26a, which have a length equal to or greater than a preselected length are grasped in the nip 46 between rollers 44, 54 prior to their release from nip 40 of rollers 32, 38. The strands 26a are thereafter moved away from first conveyor belt 12 to top run 60 of second conveyor belt 14 for further processing. Undesired strands 26b, which have a length less than the preselected length, are not grasped in nip 46 between rollers 44, 54 and fall through gap 50 into collection bin 52.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

We claim:

1. A method of sorting thin wood strands of varying lengths into desired strands having a length equal to or above a preselected length and undesired strands having a length less than the preselected length comprising the steps of:

depositing a plurality of wood strands having varying lengths onto a top run of moving conveyor means with the lengthwise dimension of the strands at an angle of from about 30° to about 60° of the direction of motion of the conveyor belt;

driving the conveyor means to move the top run toward a discharge end of the conveyor means and convey the strands to the discharge end of the conveyor means;

continuously holding with holding means the strands as they pass the discharge end of the conveyor means in a plane in which the top run of the conveyor means travels in the area adjacent the discharge end until the strands are released by the holding means;

grasping the forward ends of desired strands having a length equal to or greater than the preselected length with grasping means located a distance away from the end of the first conveyor means before the rearward ends of the desired strands are released by the holding means;

forming a gap between said holding means and said grasping means;

dropping undesired strands having a length less than the preselected length into the gap between the holding means and the grasping means; and conveying the desired strands away from said holding means.

2. A method in accordance with claim 1 wherein the step of continuously holding the strands in said plane includes contacting the conveyor means with a holding roller located above and in longitudinal alignment with a support roller of the conveyor means at the discharge end thereof with sufficient force to continuously hold the desired strands substantially in said plane until the desired strands are grasped by the grasping means.

3. A method of sorting thin wood strands of varying lengths into desired strands having a length equal to or greater than a preselected length and undesired strands having a length less than the preselected length comprising the steps of:

depositing a plurality of wood strands having varying lengths onto a top run of a moving first conveyor belt with the lengthwise dimension of the strands at an angle of from about 30° to about 60° to the direction of motion of the first conveyor belt;

driving the first conveyor belt to move the top run toward a discharge end of the conveyor belt and convey the strands to the discharge end of the conveyor belt;

continuously holding the strands as they pass the discharge end in a first nip between a support roller about which the first conveyor belt passes at the discharge end and a holding roller above said support roller in the plane in which the top run of the conveyor belt travels in the area adjacent the discharge end until the strands pass through said first nip;

grasping the forward ends of desired strands having a length equal to or greater than a preselected length in a second nip formed between a pair of grasping rollers located a distance away from said first nip before the rearward ends of the desired strands leave said first nip;

forming a gap between said first and second nips;

dropping undesired strands having a length less than the preselected length into said gap; and conveying the desired strands away from said first nip.

4. A method in accordance with claim 3 wherein the step of conveying the desired strands away from said first nip includes carrying the desired strands on a second conveyor belt, and wherein a first of said grasping rollers is a support roller of said second conveyor belt located at the inlet end of the second conveyor belt.

5. A method in accordance with claim 4 wherein the step of continuously holding the strands includes contacting the first conveyor belt at the discharge end thereof with said holding roller with sufficient force to continuously hold the desired strands substantially in said plane until the desired strands are grasped in said second nip.

* * * * *